US010992044B2

(12) United States Patent
Tan et al.

(10) Patent No.: US 10,992,044 B2
(45) Date of Patent: Apr. 27, 2021

(54) ANTENNA SYSTEM, COMMUNICATION TERMINAL AND BASE STATION

(71) Applicant: AAC Technologies Pte. Ltd., Singapore (SG)

(72) Inventors: Yewchoon Tan, Singapore (SG); Guanhong Ng, Singapore (SG); Yewsiow Tay, Singapore (SG)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/563,928

(22) Filed: Sep. 9, 2019

(65) Prior Publication Data

US 2020/0212580 A1 Jul. 2, 2020

(30) Foreign Application Priority Data

Dec. 29, 2018 (CN) ..... 201811636520.6

(51) Int. Cl.

| | |
|---|---|
| ***H01Q 9/04*** | (2006.01) |
| ***H01Q 1/24*** | (2006.01) |
| ***H01Q 21/06*** | (2006.01) |
| ***H01Q 1/38*** | (2006.01) |
| ***H01Q 13/10*** | (2006.01) |

(52) U.S. Cl.

CPC ..... *H01Q 9/0457* (2013.01); *H01Q 1/246* (2013.01); *H01Q 1/38* (2013.01); *H01Q 9/0407* (2013.01); *H01Q 13/106* (2013.01); *H01Q 21/065* (2013.01)

(58) Field of Classification Search

CPC ..... H01Q 21/065; H01Q 9/0407; H01Q 21/0006; H01Q 9/0457; H01Q 5/50; H01Q 1/38; H01Q 9/0414; H01Q 1/48; H01Q 9/0485; H01Q 13/106; H01Q 13/10; H01Q 13/18; H01Q 1/422; H01Q 19/138; H01Q 21/0075; H01Q 9/04; H01Q 9/045; H01Q 1/246; H01Q 3/30; H01Q 1/50

See application file for complete search history.

(56) References Cited

U.S. PATENT DOCUMENTS

| | | | | |
|---|---|---|---|---|
| 7,847,739 | B2 * | 12/2010 | Achour | H01Q 1/38 343/700 MS |
| 8,643,564 | B2 * | 2/2014 | Shimayama | H01P 5/028 343/850 |
| 9,692,126 | B2 * | 6/2017 | Sharawi | H01Q 21/065 |

(Continued)

*Primary Examiner* — Vibol Tan

(74) *Attorney, Agent, or Firm* — W&G Law Group LLP

(57) ABSTRACT

An antenna system, a communication terminal and a base station are provided. The antenna system includes a system ground unit having a receiving hole penetrating therethrough; and a millimeter wave antenna unit embedded in and fixed to the receiving hole. The millimeter wave antenna unit includes: a radiator, a first substrate layer, a second substrate layer, a feeding body, a third substrate layer, and a grounding layer that are stacked. The feeding body is provided with a slit strip and a feeding port, the slit strip has an opening penetrating to one of sides of the feeding body, the feeding port is disposed adjacent to the opening, the grounding layer is electrically connected to the system ground unit, and the radiator is coupled with the feeding body. The antenna system can achieve omnidirectional radiation and has a scanning angle of over 100 degrees.

9 Claims, 25 Drawing Sheets

(56) References Cited

U.S. PATENT DOCUMENTS

| | | | | |
|---|---|---|---|---|
| 10,056,922 | B1 * | 8/2018 | Tsvelykh | H04B 1/04 |
| 10,777,897 | B2 * | 9/2020 | Choon | H01Q 1/48 |
| 2014/0285378 | A1 * | 9/2014 | Hong | H01Q 21/29 342/367 |
| 2017/0237178 | A1 * | 8/2017 | Hu | H01Q 21/0025 343/700 MS |
| 2019/0288377 | A1 * | 9/2019 | Ying | H01Q 1/243 |

* cited by examiner

ANTENNA SYSTEM, COMMUNICATION TERMINAL AND BASE STATION

TECHNICAL FIELD

The present disclosure relates to the technical field of communication electronic products, and in particular, to an antenna system, a communication terminal, and a base station.

BACKGROUND

Nowadays, a communication technology has been developed to a fifth generation (5G), which requires a higher data transmission rate. To meet this requirement, a spectrum of a 5G network will be extended to a millimeter wave range. Therefore, there may be a higher requirement for millimeter wave antennas with RF above 20 GHz. Millimeter wave antennas are typically arranged in an array in which a plurality of identical antenna elements are adopted, and typically achieve high gain due to increased free space path loss in a high frequency millimeter band. Also, at millimeter wave frequencies, a communication link may be interrupted if a line of sight (LOS) is not maintained between a transmitter and a receiver. Therefore, it is important that the millimeter wave antennas can control an entire radiation pattern to maintain the line of sight (LOS). Moreover, high carrier frequency and large bandwidth characteristics that are unique to the millimeter wave antenna are the main means to achieve 5G ultra-high data transmission rate. Thus, rich bandwidth resources of the millimeter wave band provide a guarantee for a high-speed transmission rate.

However, due to severe spatial loss of electromagnetic waves in this frequency band, a wireless communication antenna system using the millimeter wave band needs to adopt a phased array architecture. Phases of the respective array elements are distributed by a phase shifter, thereby forming a high-gain beam, and the beam performs scanning in a certain space range by changing of the phase shift. However, in the millimeter wave band, if LOS communication cannot be maintained between the transmitter and the receiver of the antenna system, the communication link is easily interrupted, and if a bandwidth thereof covered within the beam range is limited, thus reliability of the antenna system may be affected.

BRIEF DESCRIPTION OF DRAWINGS

Many aspects of the exemplary embodiment can be better understood with reference to the following drawings. Components in the drawings are not necessarily drawn to scale, the emphasis instead being placed upon clearly illustrating the principles of the present disclosure. Moreover, in the drawings, like reference numerals designate corresponding parts throughout the several views.

REFERENCE SIGNS

Figure 1:
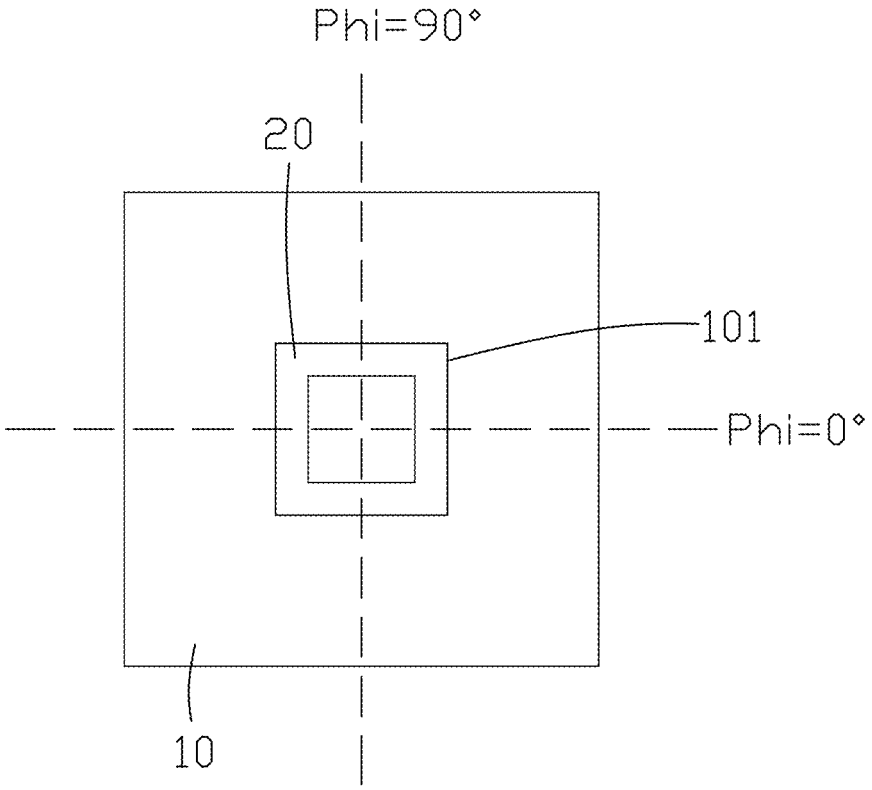
FIG. 1 is a schematic top view of an antenna system in accordance with a first embodiment of the present disclosure.
Figure 2:
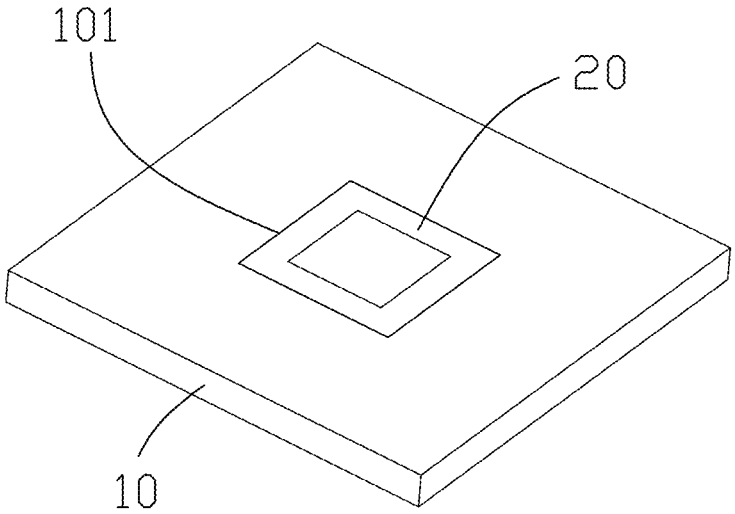
FIG. 2 is a schematic perspective view of an antenna system in accordance with the first embodiment of the present disclosure.
Figure 3:
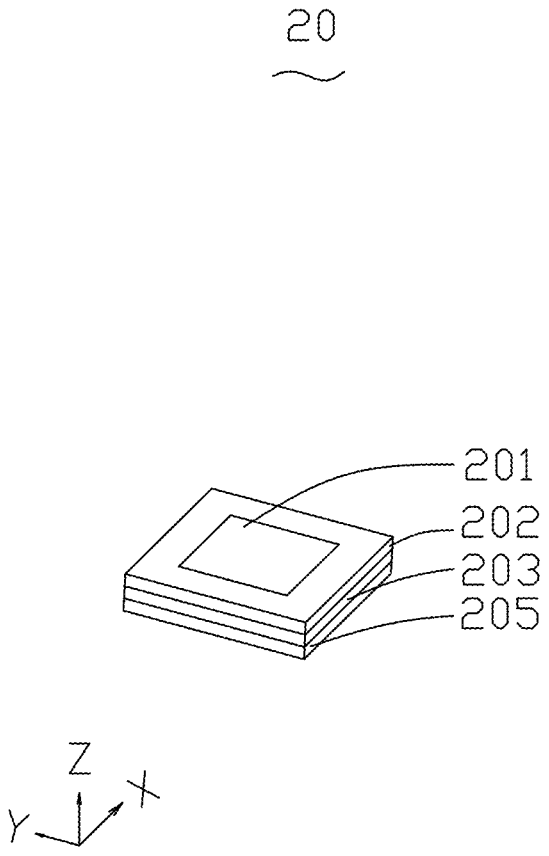
FIG. 3 is a perspective view of a millimeter wave antenna unit in accordance with the first embodiment of the present disclosure.
Figure 4:
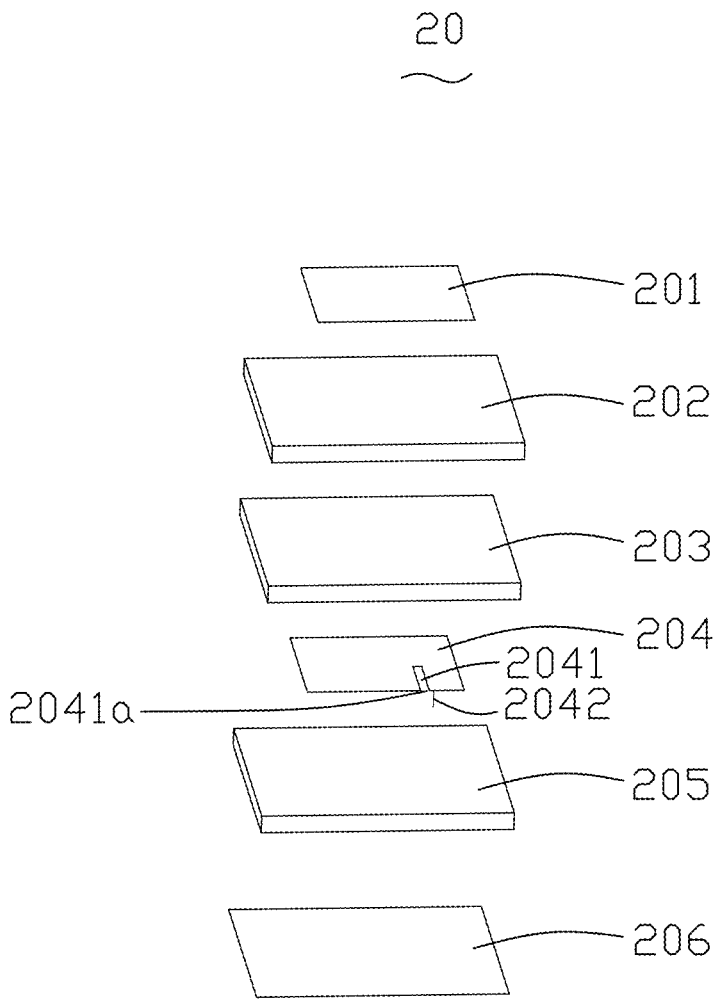
FIG. 4 is an exploded view of a millimeter wave antenna unit in accordance with the first embodiment of the present disclosure.

10—system ground unit;
20—millimeter wave antenna unit;
20*a*—first unit;
20*b*—second unit;
20*c*—third unit;
20*d*—fourth unit;
101—receiving hole;
201—radiator;
202—first substrate layer;
203—second substrate layer;
204—feeding body;
205—third substrate layer;
206—grounding layer;
2041—slit strip;
2042—feeding port;
2041*a*—opening.

DESCRIPTION OF EMBODIMENTS

The present disclosure will be further described in the following with reference to accompanying drawings and embodiments.

First Embodiment

As shown in FIG. 1 to FIG. 4, an antenna system includes a system ground unit 10 and a millimeter wave antenna unit 20. The system ground unit 10 includes a receiving hole 101 penetrating therethrough, and the millimeter wave antenna unit 20 is embedded in and fixed to the receiving hole 101. The millimeter wave antenna unit 20 includes a radiator 201, a first substrate layer 202, a second substrate layer 203, a feeding body 204, a third substrate layer 205, and a grounding layer 206 that are sequentially stacked. The feeding body 204 is provided with a slit strip 2041 and a feeding port 2042, and the slit strip 2041 has an opening 2041*a* penetrating to one of sides of the feeding body 204. The feeding port 2042 is disposed adjacent to the opening 2041*a*. The grounding layer 206 is electrically connected to the system ground unit 10. The radiator 201 is space from and form coupling with the feeding body 204. In this embodiment, the radiator 201, the first substrate layer 202, the second substrate layer 203, the feeding body 204, the third substrate layer 205, and the grounding layer 206 are vertically stacked in this order to form a stacking structure.

In this embodiment, the feeding port 2042 may be a probe penetrating through the third substrate layer 205, and then connected to a feeding network or an external power source.

In this embodiment, the radiator 201 forms coupling with the feeding body 204, so as to couple energy of the feeding body 204 to the radiator 201, so that the radiator 201 forms radiation and operates at a millimeter wave of 28 GHz.

That is, the radiator 201 is not connected to the grounding layer 206; and the radiator 201 is not directly electrically connected to the feeding body 204, but forms coupling with the feeding body 204.

In this embodiment, the feeding body 204 is a capacitive feeding patch.

In this embodiment, the feeding body 204 is fixed to the third substrate layer 205. More preferably, the feeding body 204 is formed on the surface of the third substrate layer 205 by etching.

In this embodiment, the radiator 201 is a patch, and the radiator 201 is formed on the first substrate layer 202 by etching.

In this embodiment, the first substrate layer 202 and the third substrate layer 205 are made of a same material. An orthographic projection of the second substrate layer 203 onto the third substrate layer 205 and an orthographic projection of the first substrate layer 202 onto the third substrate layer 205 in a direction perpendicular to the third substrate layer 205 is completely coincident with the third substrate layer 205.

In this embodiment, one receiving hole 101 is provided, and one millimeter wave antenna unit 20 is provided.

Figure 9:
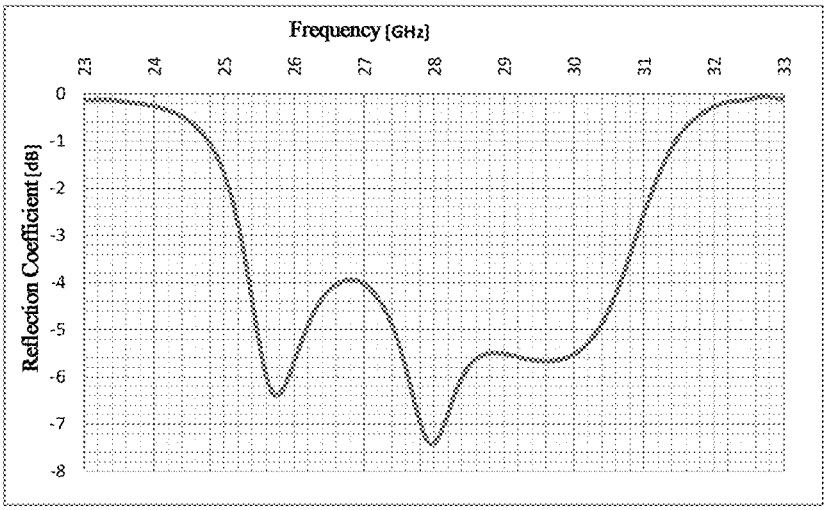
FIG. 9 illustrates a diagram of a reflection coefficient of a millimeter wave antenna unit in accordance with the first embodiment of the present disclosure.
Figure 10:
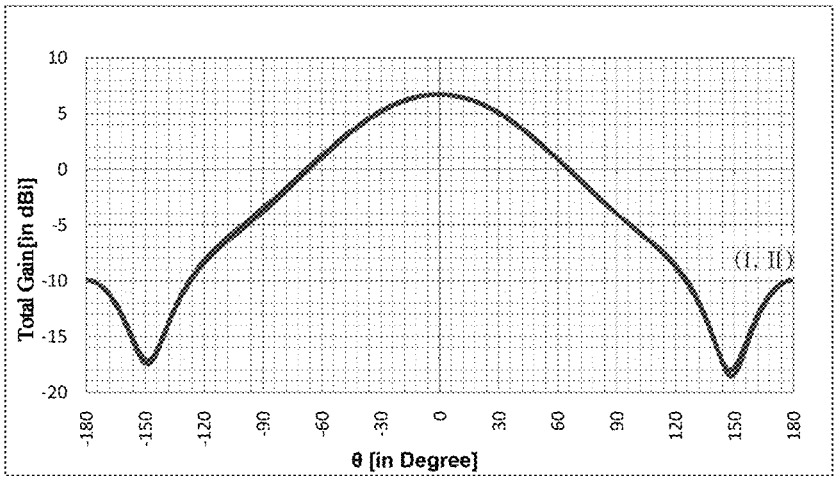
FIG. 10 illustrates a direction diagram of a millimeter wave antenna unit at 28 GHz in a Cartesian coordinate system within a PHi=0° plane and a Phi=90° plane, in accordance with the first embodiment of the present disclosure.
Figure 11:
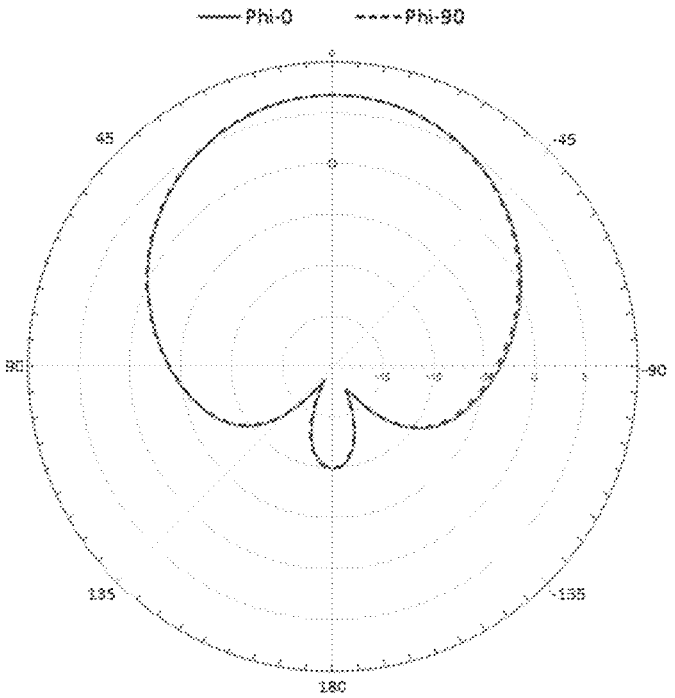
FIG. 11 illustrates a direction diagram of a millimeter wave antenna unit at 28 GHz in a Polar coordinate system within a Phi=0° plane and a Phi=90° plane, in accordance with the first embodiment of the present disclosure.

FIG. 9 illustrates a curve diagram of a reflection coefficient S11 of a single millimeter wave antenna unit 20. In the diagram shown in FIG. 9, it can be seen that resonance occurs at 28 GHz. FIG. 10 and FIG. 11 illustrates a direction diagram within a Phi=0° plane (XZ plane) and a Phi=90° plane (XZ plane), respectively. As can be seen from the diagrams shown in FIG. 10 and FIG. 11, the millimeter wave antenna unit 20 has a uniform direction diagram within the Phi=0° plane and the Phi=90° plane (in FIG. 10, a curve diagram I representing the Phi=0° plane and a curve diagram II representing the Phi=90° plane completely coincide), and the millimeter wave antenna unit 20 can achieve omnidirectional radiation.

Second Embodiment

This embodiment is different from the first embodiment in that four millimeter wave antenna units 20 are provided, which form a distribution in a 2×2 matrix.

Figure 5:
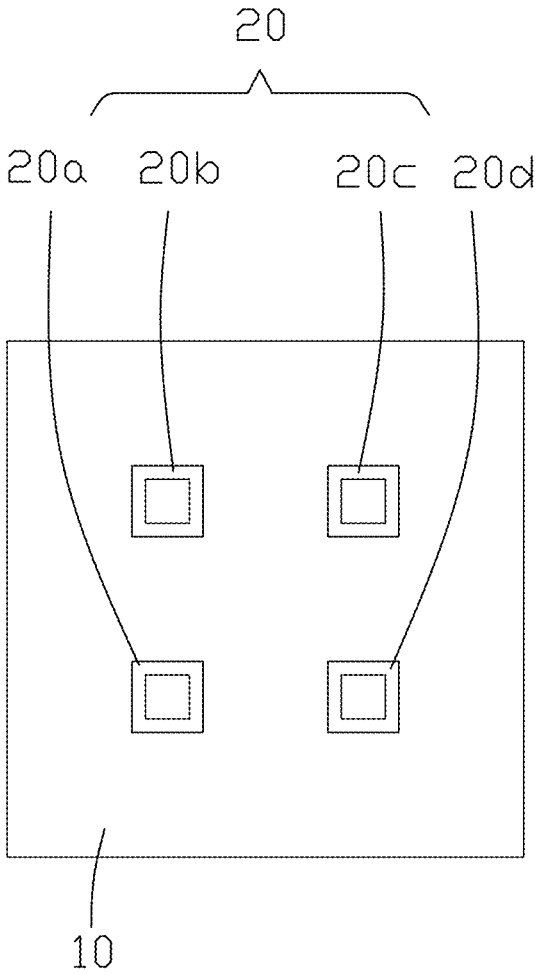
FIG. 5 is a schematic top view of an antenna system in accordance with a second embodiment of the present disclosure.
Figure 6:
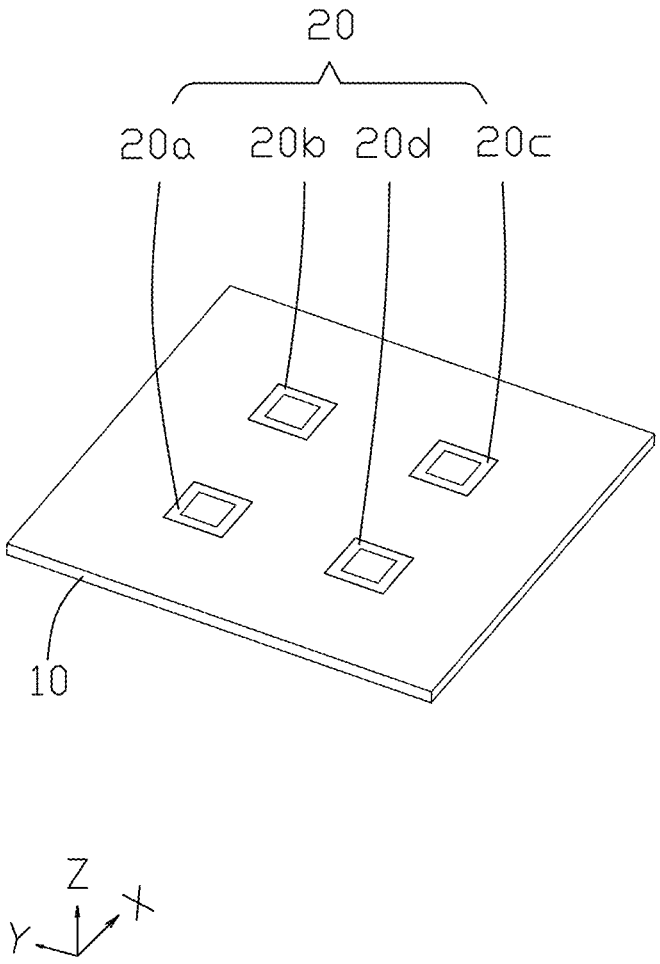
FIG. 6 is a schematic perspective view of an antenna system in accordance with the second embodiment of the present disclosure.

As shown in FIG. 5 and FIG. 6, these millimeter wave antenna units 20 include a first unit 20*a*, a second unit 20*b*, a third unit 20*c*, and a fourth unit 20*d* that are arranged in a 2×2 matrix. Such a phased array antenna structure having a smaller size is suitable for smart terminals in a 5G network, such as a cellphone and a tablet. In such a 2×2 rectangular phased array layout, the phased array is capable of performing beam forming and beam scanning at different angles of θ within any Phi plane, that is, beam scanning is substantially omnidirectional. This is achieved by introducing appropriate phase shifts of the four corresponding millimeter wave antenna units 20.

FIGS. 12-19 illustrate simulation results at 28 GHz, showing beam scanning direction diagrams of a 2×2 (4-unit) rectangular phased array antenna within a Phi=0° plane (XZ plane), a Phi=45° plane, a Phi=90° plane (YZ plane), and a Phi=315° plane.

Figure 12:
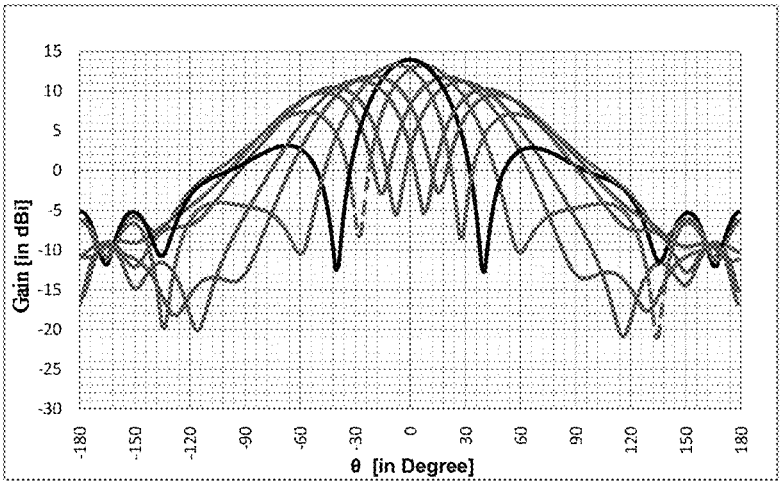
FIG. 12 illustrates a beam scanning direction diagram of an antenna system at 28 GHz in a Cartesian coordinate system within a Phi=0° plane, in accordance with the second embodiment of the present disclosure.
Figure 13:
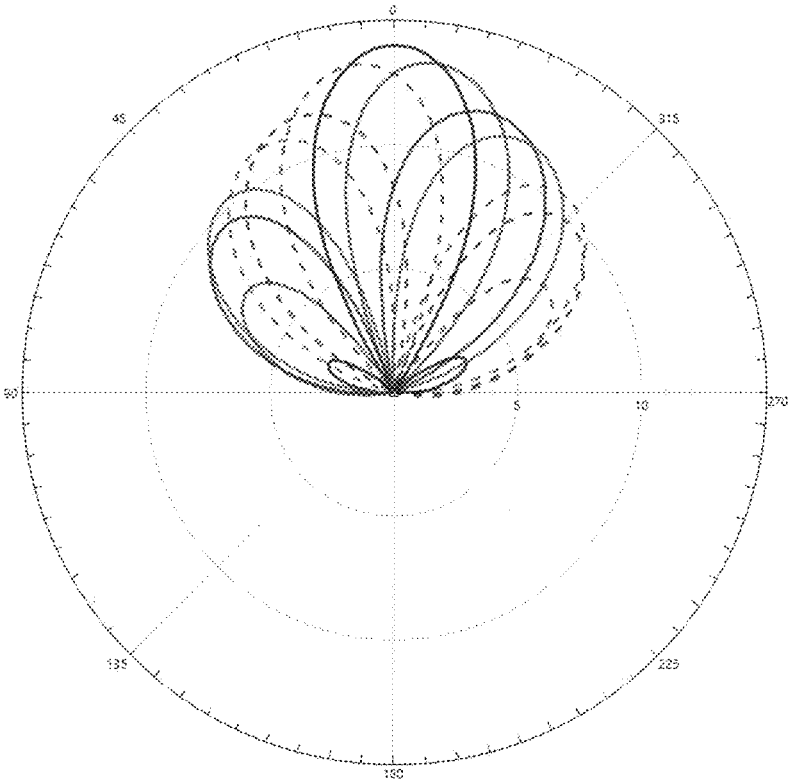
FIG. 13 illustrates a beam scanning direction diagram of an antenna system at 28 GHz in a Polar coordinate system within a Phi=0° plane, in accordance with the second embodiment of the present disclosure.
Figure 14:
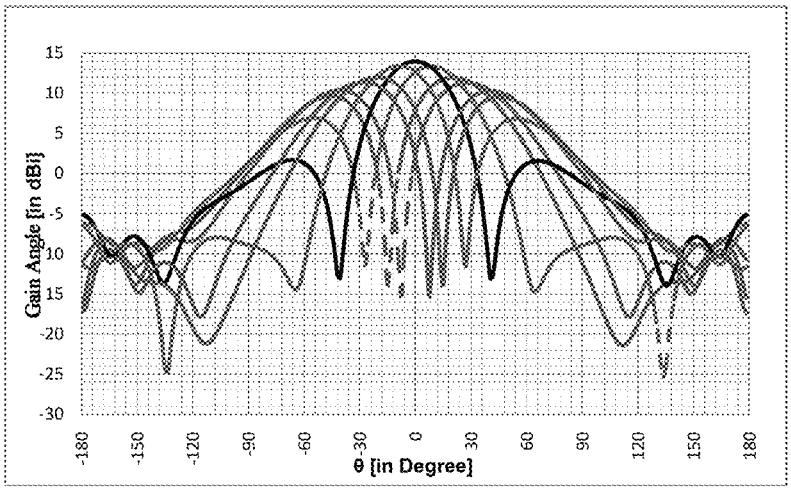
FIG. 14 illustrates a beam scanning direction diagram of an antenna system at 28 GHz in a Cartesian coordinate system within a Phi=90° plane, in accordance with the second embodiment of the present disclosure.
Figure 15:
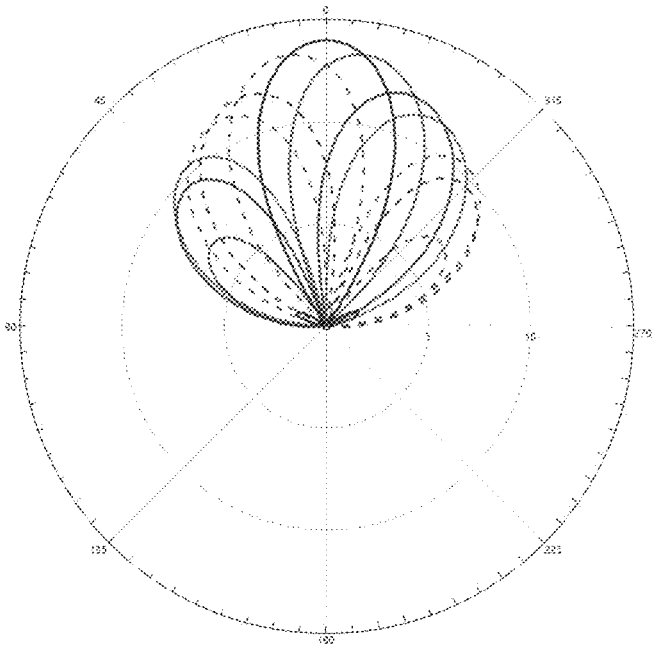
FIG. 15 illustrates a beam scanning direction diagram of an antenna system at 28 GHz in a Polar coordinate system within a Phi=90° plane, in accordance with the second embodiment of the present disclosure.
Figure 16:
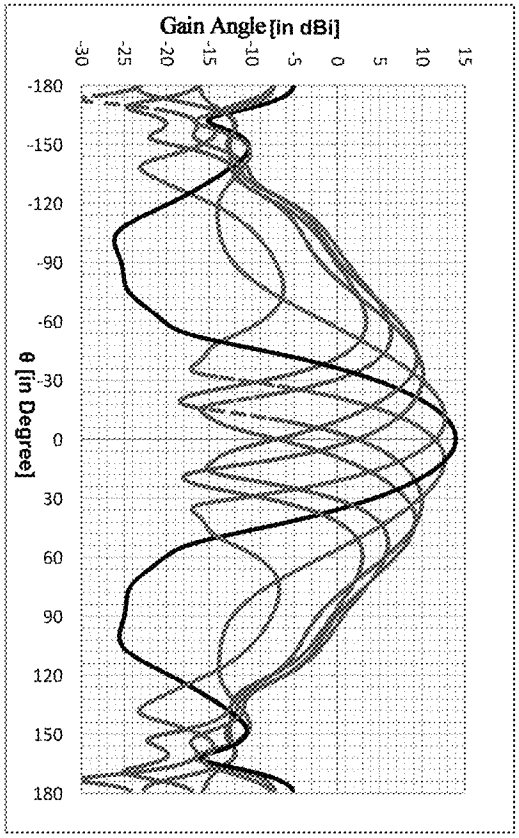
FIG. 16 illustrates a beam scanning direction diagram of an antenna system at 28 GHz in a Cartesian coordinate system within a Phi=45° plane, in accordance with the second embodiment of the present disclosure.
Figure 17:
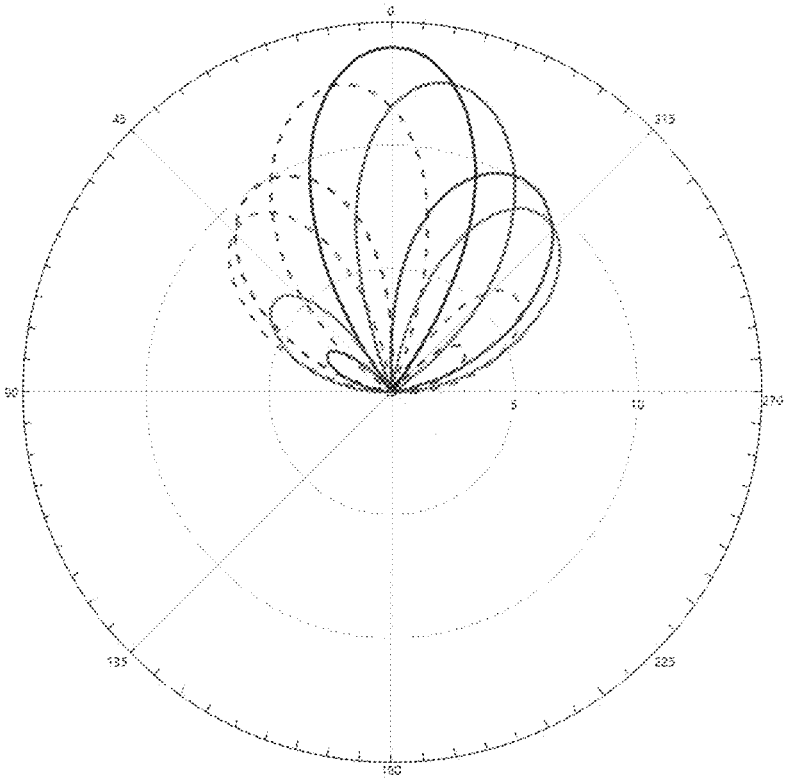
FIG. 17 illustrates a beam scanning direction diagram of an antenna system at 28 GHz in a Polar coordinate system within a Phi=45° plane, in accordance with the second embodiment of the present disclosure.
Figure 18:
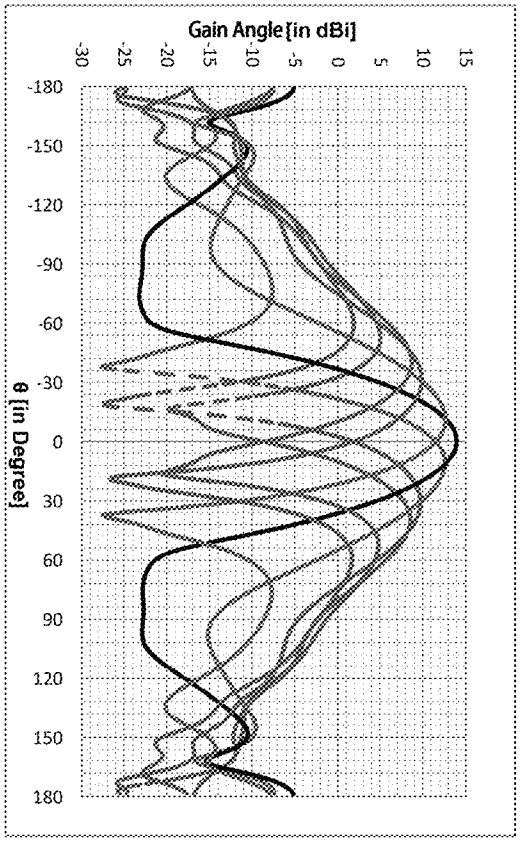
FIG. 18 illustrates a beam scanning direction diagram of an antenna system at 28 GHz in a Cartesian coordinate system within a Phi=315° plane, in accordance with the second embodiment of the present disclosure.
Figure 19:
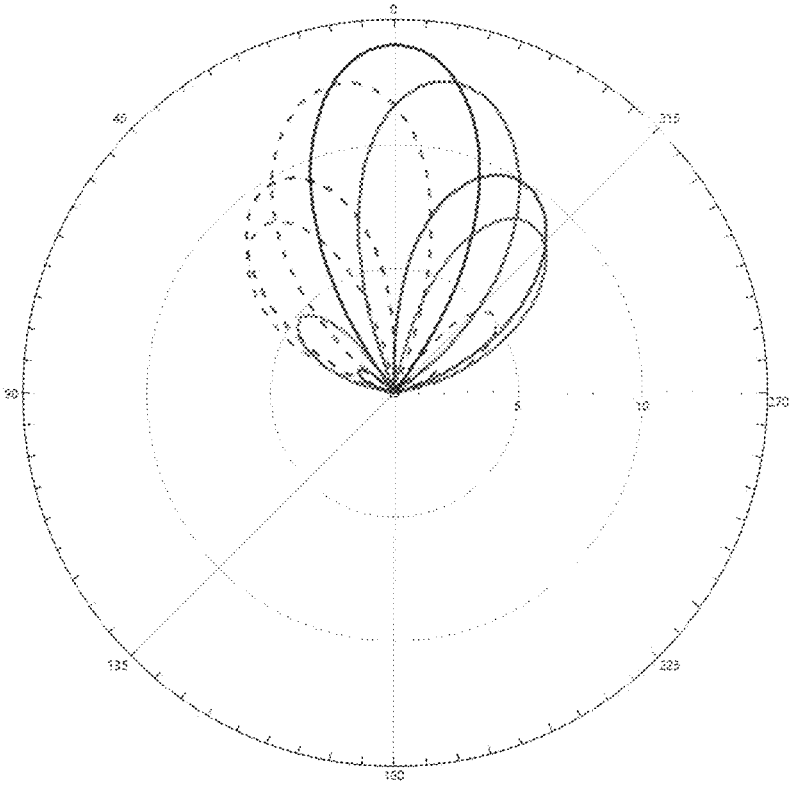
FIG. 19 illustrates a beam scanning direction diagram of an antenna system at 28 GHz in a Polar coordinate system within a Phi=315° plane, in accordance with the second embodiment of the present disclosure.

FIG. 12 shows that a main beam gain can reach 7 dBi in a scanning range from θ=−54° to θ=54° within the Phi=0° plane. A similar result can be seen from FIG. 13. FIG. 14 shows that a main beam gain can reach 7 dBi in a scanning range from θ=−54° to θ=54° within the Phi=90° plane. A similar result can be seen from FIG. 15. FIG. 16 shows that a main beam gain can reach 7 dBi in a scanning range from θ=−60° to θ=60° within the Phi=45° plane. A similar result can be seen from FIG. 17. FIG. 18 shows that a main beam gain can reach 7 dBi in a scanning range from θ=−54° to θ=54° within the Phi=135° plane. A similar result can be seen from FIG. 19.

Figure 20:
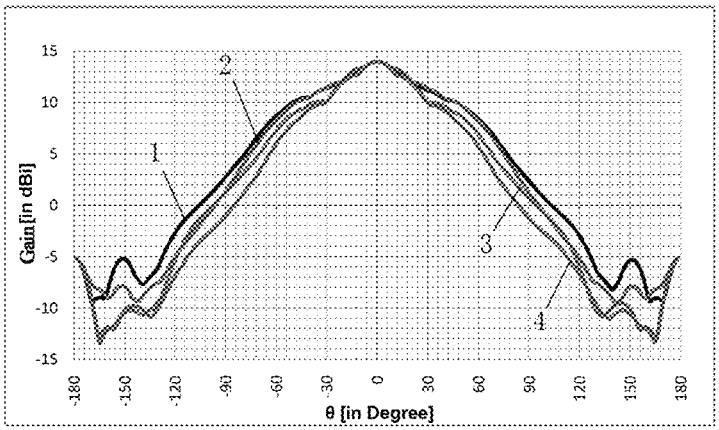
FIG. 20 is a diagram illustrating antenna total gain of an antenna system at 28 GHz within a Phi=0° plane, a Phi=45° plane, a Phi=90° plane, and a Phi=315° plane, in accordance with the second embodiment of the present disclosure.

The antenna total gain shown in FIG. 20 is a composite gain of the beam within the Phi=0° plane (corresponding to curve 1 in FIG. 20), within the Phi=45° plane (corresponding to curve 3 in FIG. 20), within the Phi=90° plane (corresponding to curve 2 in FIG. 20) and within the Phi=315° plane (corresponding to curve 4 in FIG. 20). It can be seen from FIG. 20 that the 2×2 rectangular phased array antenna can perform beam scanning within any Phi plane, thereby enabling the array antenna to achieve omnidirectional radiation. Within each Phi plane, the 2×2 rectangular phased array antenna can maintain gain above 7 dBi over a wide scanning angle of larger than 100 degrees.

Third Embodiment

This embodiment is different from the first embodiment in that sixty four millimeter wave antenna units 20 are provided, which form a distribution in an 8×8 matrix.

Figure 7:
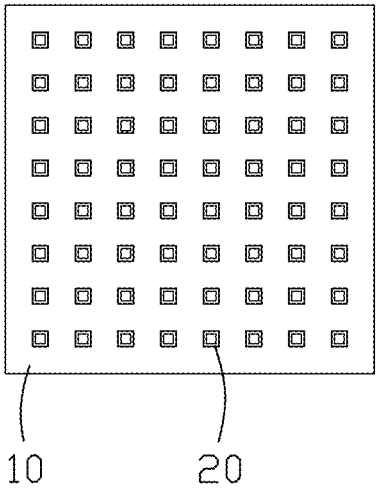
FIG. 7 is a schematic top view of an antenna system in accordance with a third embodiment of the present disclosure.
Figure 8:
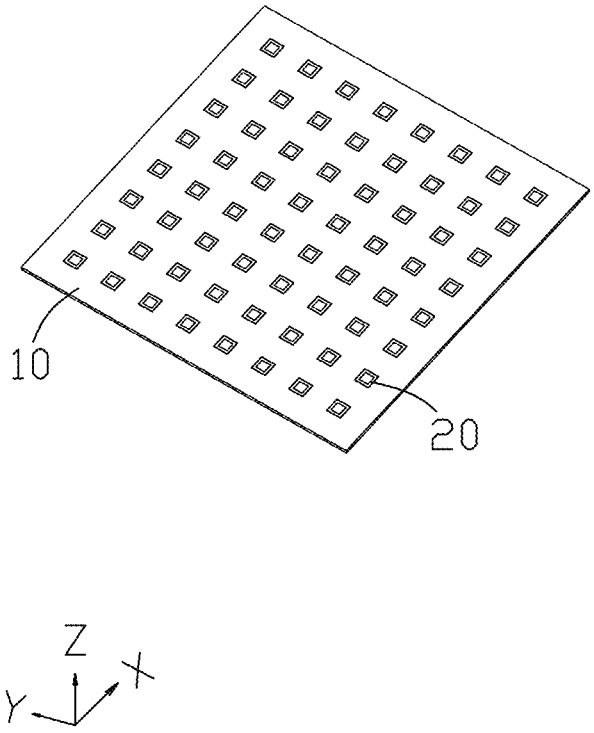
FIG. 8 is a schematic perspective view of an antenna system in accordance with the third embodiment of the present disclosure.

As shown in FIG. 7 and FIG. 8, such a phased array antenna structure having a larger size is suitable for small cellular devices in a 5G network, such as a base station. In such an 8×8 rectangular array layout, the phased array is capable of performing beam forming and beam scanning at different angles of θ within any Phi plane, that is, beam scanning is substantially omnidirectional. This is achieved by introducing appropriate phase shifts of the sixty four corresponding millimeter wave antenna units 20.

FIGS. 21-24 illustrate simulation results at 28 GHz, showing beam scanning direction diagrams of a 8×8 (64-unit) rectangular phased array antenna within a Phi=0° plane (XZ plane), a Phi=45° plane, a Phi=90° plane (YZ plane), and a Phi=315° plane.

Figure 21:
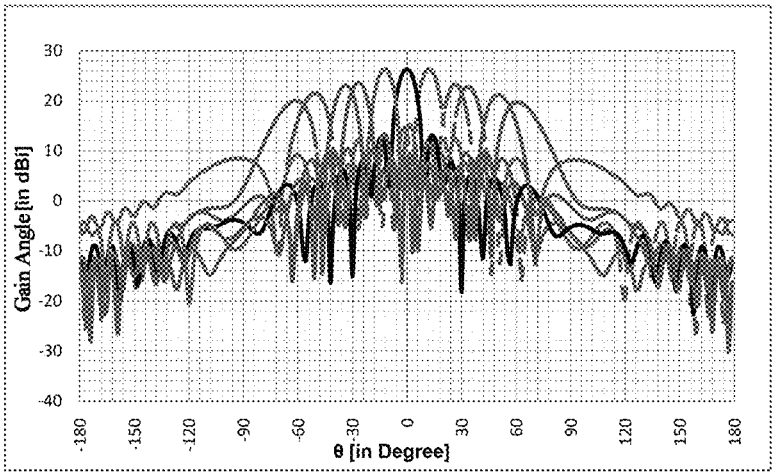
FIG. 21 illustrates a beam scanning direction diagram of an antenna system at 28 GHz in a Cartesian coordinate system within a Phi=0° plane, in accordance with the third embodiment of the present disclosure.
Figure 22:
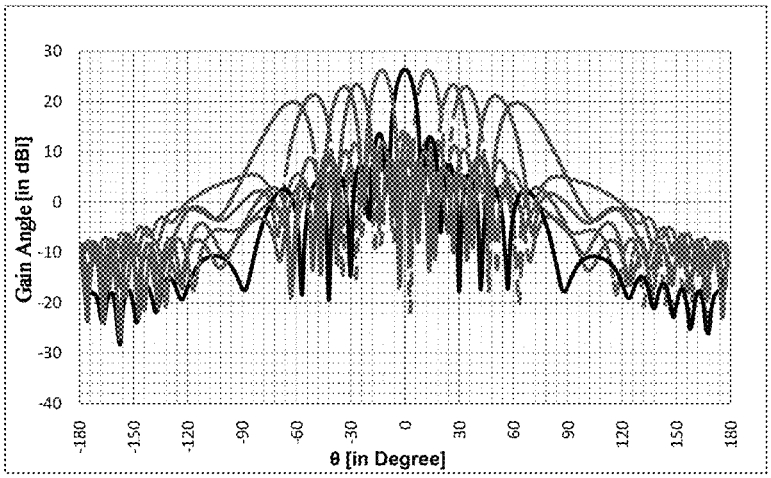
FIG. 22 illustrates a beam scanning direction diagram of an antenna system at 28 GHz in a Cartesian coordinate system within a Phi=90° plane, in accordance with the third embodiment of the present disclosure.
Figure 23:
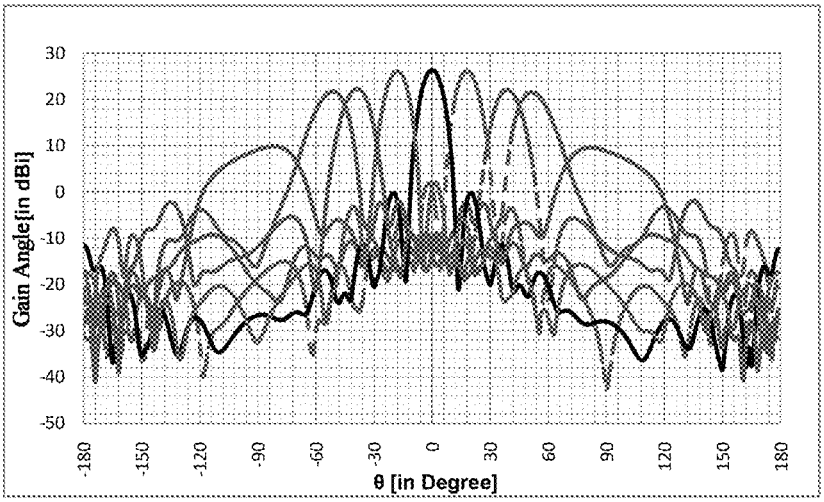
FIG. 23 illustrates a beam scanning direction diagram of an antenna system at 28 GHz in a Cartesian coordinate system within a Phi=45° plane, in accordance with the third embodiment of the present disclosure.
Figure 24:
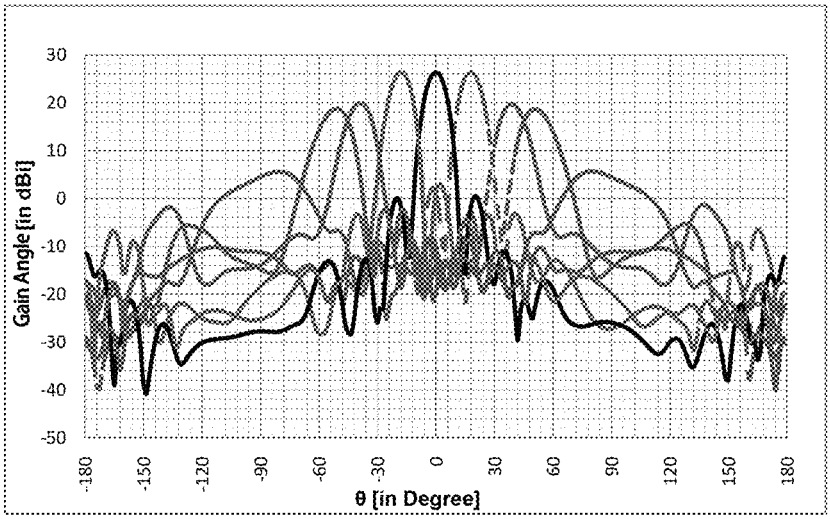
FIG. 24 illustrates a beam scanning direction diagram of an antenna system at 28 GHz in a Cartesian coordinate system within a Phi=315° plane, in accordance with the third embodiment of the present disclosure.

FIG. 21 shows that a main beam gain can reach 15 dBi in a scanning range from θ=−42° to θ=42° within the Phi=0° plane. FIG. 22 shows that a main beam gain can reach 15 dBi in a scanning range from θ=−42° to θ=42° within the Phi=90° plane. FIG. 23 shows that a main beam gain can reach 15 dBi in a scanning range from θ=−63° to θ=63° within the Phi=45° plane. FIG. 24 shows that a main beam gain can reach 15 dBi in a scanning range from θ=−60° to θ=60° within the Phi=135° plane.

Figure 25:
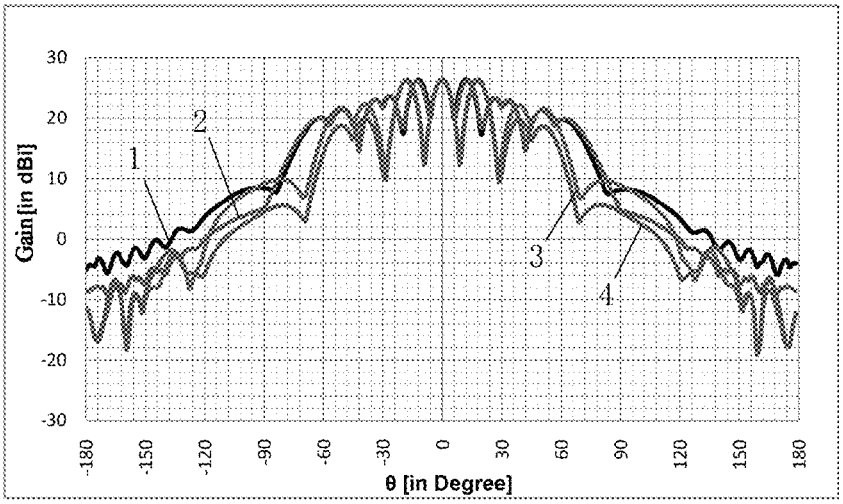
FIG. 25 is a diagram illustrating antenna total gain of an antenna system at 28 GHz within a Phi=0° plane, a Phi=45° plane, a Phi=90° plane, and a Phi=315° plane, in accordance with the third embodiment of the present disclosure.

The antenna total gain shown in FIG. 25 is a composite gain of the beam within the Phi=0° plane (corresponding to curve 1 in FIG. 25), within the Phi=45° plane (corresponding to curve 3 in FIG. 25), within the Phi=90° plane (corresponding to curve 2 in FIG. 25) and within the Phi=315° plane (corresponding to curve 4 in FIG. 25). It can be seen from FIG. 25 that the 8×8 rectangular phased array antenna can perform beam scanning within any Phi plane, thereby enabling the array antenna to achieve omnidirectional radiation. Within each Phi plane, the 8×8 rectangular phased array antenna can maintain gain above 15 dBi over a wide scanning angle of larger than 100 degrees. It should be noted that, in the antenna system of the present disclosure, the number of millimeter wave antenna unit 20 is not limited to one, four, sixty four, etc., and may be other number, as long as they are distributed in a matrix. It is also possible to form a phased array antenna system having a larger size, so as to achieve a desired total gain of the antenna system.

The present disclosure further provides a communication terminal, including the above-described antenna system provided by the present disclosure.

The present disclosure further provides a base station, including the above-described antenna system provided by the present disclosure. Compared with the related art, the antenna system provided by the present disclosure includes one or more millimeter wave antenna units, thereby forming a high-gain beam, and beam scanning can be performed in a large space range by changing the phase shift. In this way, it can allow the LOS communication between the transmitter and the receiver of the system to be uninterrupted, so that the signal of the communication terminal or base station communication using the antenna system is strong and stable, the reliability is excellent, and the frequency band coverage is wide.

The above-described embodiments are merely preferred embodiments of the present disclosure and are not intended to limit the present disclosure. Any improvements made by those skilled in the art within the principle of the present disclosure shall fall into the protection scope of the present disclosure.

What is claimed is:

1. An antenna system, comprising:

a system ground unit (10) having a receiving hole (101) penetrating therethrough; and a millimeter wave antenna unit (20) embedded in and fixed to the receiving hole (101), wherein the millimeter wave antenna unit (20) comprises: a radiator (201), a first substrate layer (202), a second substrate layer (203), a feeding body (204), a third substrate layer (205), and a grounding layer (206) that are stacked, and wherein the feeding body (204) is provided with a slit strip (2041) and a feeding port (2042), the slit strip (2041) comprises an opening (2041*a*) penetrating to one of sides of the feeding body (204), the feeding port (2042) is disposed adjacent to the opening (2041*a*), the grounding layer (206) is electrically connected to the system ground unit (10), and the radiator (201) is coupled with the feeding body (204);

wherein the first substrate layer (202) and the third substrate layer (205) are made of a same material, and orthographic projections of the second substrate layer (203) and the first substrate layer (202) onto the third substrate layer (205) in a direction perpendicular to the third substrate layer (205) are completely coincident with the third substrate layer (205).

2. The antenna system as described in claim 1, wherein the feeding body (204) is a capacitive feeding patch.

3. The antenna system as described in claim 2, wherein the feeding body (204) is fixed to the third substrate layer (205).

4. The antenna system as described in claim 3, wherein the feeding body (204) is formed on a surface of the third substrate layer (205) by etching.

5. The antenna system as described in claim 1, wherein the radiator (201) is a patch, and the radiator (201) is formed on the first substrate layer (202) by etching.

6. The antenna system as described in claim 1, wherein the feeding body (204) is of a square shape, and the slit strip (2041) is offset from a central axis of the feeding body (204).

7. The antenna system as described in claim 1, wherein N receiving holes (101) and N millimeter wave antenna units (20) are provided, the N millimeter wave antenna units (20) being distributed in a matrix to form a phased array antenna system.

8. A communication terminal, comprising the antenna system as described in claim 1.

9. A base station, comprising the antenna system as described in claim 1.

* * * * *